US005976361A

United States Patent [19]

Hood et al.

[11] Patent Number: 5,976,361

[45] Date of Patent: Nov. 2, 1999

[54] METHOD OF AND MEANS FOR UPGRADING HYDROCARBONS CONTAINING METALS AND ASPHALTENES

[75] Inventors: Richard L. Hood, Edmond, Okla.; Phillip B. Rettger, Walnut Creek; Randall S. Goldstein, Moraga, both of Calif.; Lucien Y. Bronicki, Yavne, Israel; Benjamin Doron, Jerusalem, Israel; Joseph Sinai, Ramat Gan, Israel

[73] Assignee: Ormat Industries Ltd., Yavne, Israel

[21] Appl. No.: 08/910,102

[22] Filed: Aug. 13, 1997

[51] Int. Cl.[6] ..... C10C 3/00

[52] U.S. Cl. ..... 208/309; 208/86; 208/87; 208/96; 196/14.52

[58] Field of Search ..... 208/309, 86, 87, 208/96; 196/14.52

[56] References Cited

U.S. PATENT DOCUMENTS

| | | |
|---|---|---|
| 2,940,920 | 6/1960 | Garwin . |
| 3,005,769 | 10/1961 | Garwin . |
| 3,053,751 | 9/1962 | Garwin . |
| 4,191,636 | 3/1980 | Fukui et al. . |
| 4,454,023 | 6/1984 | Lutz . |
| 4,528,100 | 7/1985 | Zarchy . |
| 4,686,028 | 8/1987 | Van Driesen et al. . |
| 5,192,421 | 3/1993 | Audeh et al. . |
| 5,601,697 | 2/1997 | Miller et al. . |

*Primary Examiner*—Helane Myers
*Attorney, Agent, or Firm*—Nath & Associates; Gary M. Nath; Jerald L. Meyer

[57] ABSTRACT

A hydrocarbon source feed is upgraded using a solvent deasphalting (SDA) unit employing a solvent having a critical temperature $T_c$ by initially separating from a first hydrocarbon input stream fractions with an atmospheric equivalent boiling temperature less than about $T_f$° F. for producing a stream of $T_f^-$ fractions and a residue stream ($T_f^+$ stream), where $T_f$ is greater than about $T_c$−50° F. In the SDA unit, a second hydrocarbon input stream which includes the residue stream is deasphalted for producing a first product stream of substantially solvent-free asphaltenes, and a second product stream containing substantially solvent-free deasphalted oil (DAO). The source feed may be included in either the first or second input streams. The DAO in the second product stream is thermally cracked for producing an output stream that includes thermally cracked fractions and by-product asphaltenes produced by thermally cracking the DAO. Finally, at least some the said thermally cracked fractions are included in the first input stream.

28 Claims, 5 Drawing Sheets

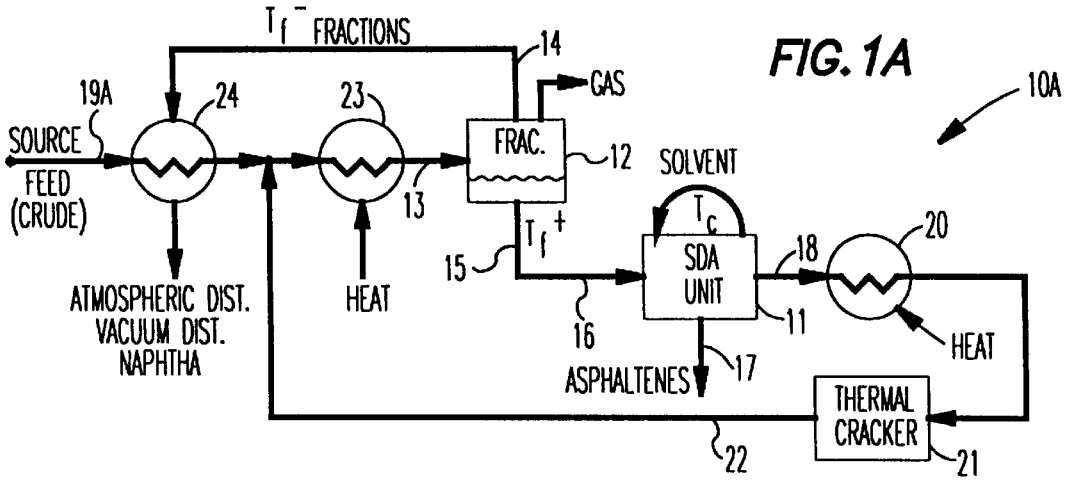
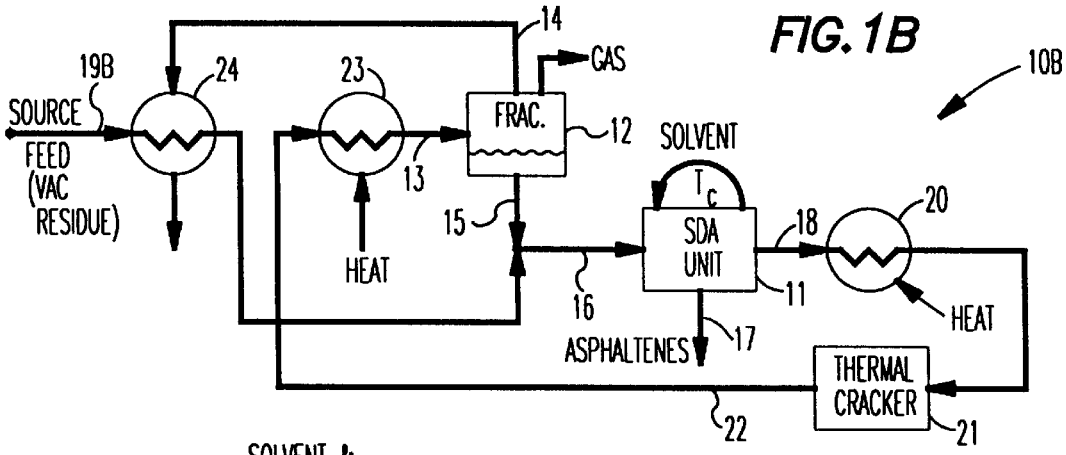
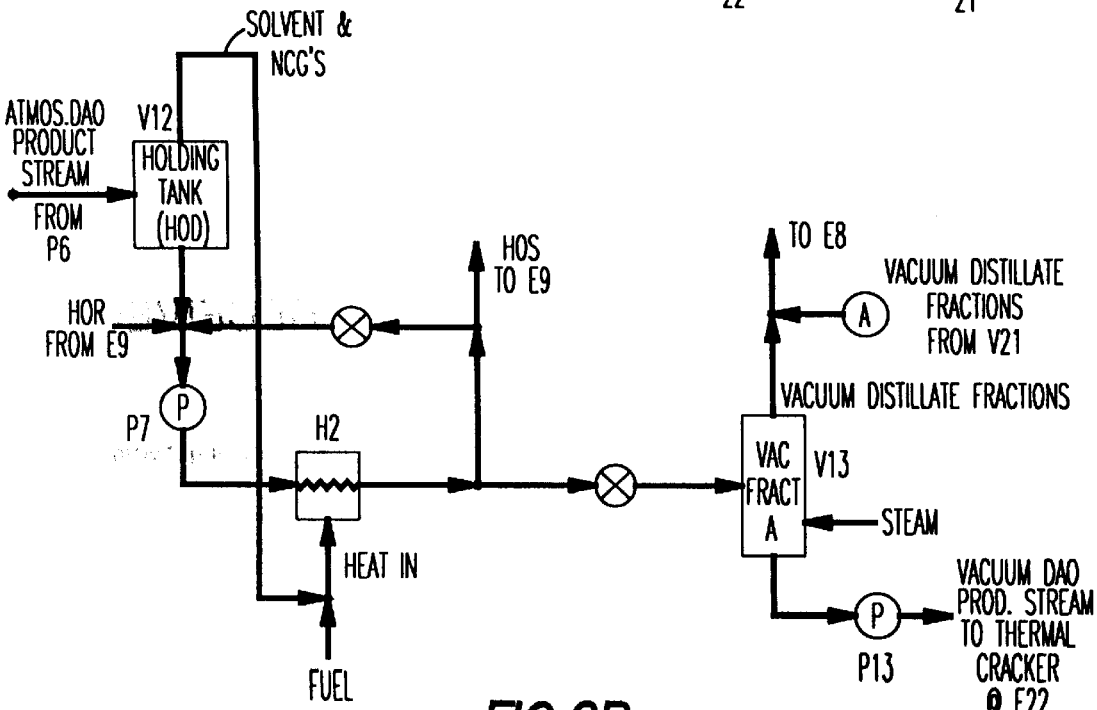
FIG.2B

OPTIONAL FEEDBACK FROM THERM.CRACKER
31
E1
HC FEED
E2
H1
41
33
V1
32
DAO SEP.
V3
39
FROM HOS
E9
TO HOR
HEAT
34'
P1
TO W
TO E7
40
E3
40
37
E8
FLASH V5
34
FROM V4,V5
FROM V13 & V21
E7
38
E4
COOLER
STEAM
STRIP V7
HOS
E5
TO E12
P6
TO E7
HOR
E11
E6
TO V12 ATMOS. DAO PROD. STREAM
34"
MIXER
M1
35
FLASH V4
30
STEAM
STRIP V6
18'
ASPH SEP.
E10
ASPHALTENE PRODUCT TO M3 @ B
V2
FROM V19
C
E19
P5
36
P2

E13
FROM E7
T
G
E14
SOL. TANK
V10
E12
SEP V8
P3,P4
P12
V15
SEP
V9
W
SEP
SEP
E18
V16
E15
V14
SEP
WATER
P9
P10
WATER
TO TANKAGE OR PIPELINE
Z
E20

METHOD OF AND MEANS FOR UPGRADING HYDROCARBONS CONTAINING METALS AND ASPHALTENES

TECHNICAL FIELD

This invention relates to upgrading of hydrocarbons containing metals and asphaltenes and more particularly is concerned with a method of and means for upgrading such hydrocarbons prior to their use as fuel in power generation systems or as refinery feedstocks.

BACKGROUND TO THE INVENTION

Many liquid hydrocarbons are comprised of various fractions which vaporize under atmospheric or subatmospheric pressure, at different temperatures. In typical practice, such hydrocarbons are fractionated by heating and vaporizing one or more of such fractions to separate the lighter, lower boiling range fractions from the heavier, higher boiling range material. Since the process of fractionation separates the lighter, lower boiling range fractions as vapors, certain constituents of the hydrocarbons which do not vaporize remain in the heavier, higher boiling range portion of the hydrocarbon. Examples of constituents with this characteristic include metals, asphaltenes (pentane-insolubles), and coke pre-cursors, such as those measured by ASTM test procedures D-189 and designated as Conradson Carbon Residue (CCR).

These constituents are a problem for a variety of potential users of the heavier, higher boiling range portion of the hydrocarbon. Examples of users for whom such constituents present a problem include power generation devices, such as combustion turbines and internal combustion engines, and refinery process units such as catalyst-based cracking and hydrotreating units and thermal cracking units.

An example of a user that is effected by the constituents present in the heavier, higher boiling range portion of oil is the combustion turbine, which is one of the lowest cost, highest efficiency power generation systems available today. Combustion turbines can also be configured in a combined cycle configuration to further increase the efficiency of a power generation cycle. Combustion turbines can be damaged when using liquid fuels that contain significant amounts of metals. To avoid such damage, users of combustion turbines can: (1) use fuel with low levels of metals, (2) use fuel pre-processing systems to reduce the level of metals in the fuel burned, (3) add chemicals to the fuel to reduce the negative impacts of the metals in the fuel, or (4) operate the combustion turbine at a lower, and less efficient firing temperature to reduce the impact of the metals. Each of these options results in an increased cost of power generation, whether from additional capital, additional operating costs, or lower power generation efficiency.

One of the lowest cost liquid fuels available for use in combustion turbines is heavy fuel oil. Such oil is produced by mixing the heavier, higher boiling range portion of the hydrocarbon with sufficient light petroleum diluent, e.g., diesel fuel, to achieve the desired product properties. While the resultant heavy fuel oil usually has a lower cost than other liquid fuel products, the level of metals in the oil is usually higher, causing higher operating and maintenance costs and lower power generation efficiencies in combustion turbines. Moreover, such heavy fuel oil contains some amount of light petroleum product as diluent and the diluent alone has a higher value than that of the heavy fuel oil.

Conventionally, the low quality of the heavy fuel oil can be improved prior to use by fuel treatment systems such as centrifuging or settling to remove sediment, water washing to remove water soluble corrosive salts, and the addition of inhibitors to control the effect of nonremovable corrosive elements.

The cost of heavy fuel oil can be reduced by purchasing a lower quality product, which then requires the use of a greater amount of fuel treatment, which results in lower combustion turbine efficiency and increases downtime.

In U.S. Pat. No. 4,191,636, heavy oil is continuously converted into asphaltenes and metal-free oil by hydrotreating the heavy oil to crack asphaltenes selectively and remove heavy metals such as nickel and vanadium simultaneously. The liquid products are separated into a light fraction of an asphaltene-free and metal-free oil and a heavy fraction of an asphaltene and heavy metal-containing oil. The light fraction is recovered as a product and the heavy fraction is recycled to the hydrotreating step.

In U.S. Pat. No. 4,528,100, a process for the treatment of residual oil is disclosed, the process comprising the steps of treating the residual oil so as to produce a first extract and a first raffinate using supercritical solvent extraction, and then treating the first raffinate so as to produce a second extract and a second raffinate again by supercritical solvent extraction using a second supercritical solvent and then combining the first extract and the raffinate to a product fuel. In accordance with a particular embodiment of the invention disclosed in the U.S. '100 patent, the supercritical solvents are particularly selected to concentrate vanadium in the second extract. Thus, even though the amount of vanadium present in the product fuel is low and consequently beneficial for reducing gas turbine maintenance problems as stated in this U.S. '100 patent, some amount of vanadium does still remain therein.

Another example of a user of the heavier, higher boiling range portion of a hydrocarbon is a refinery with a fluid catalytic cracking unit (an FCC unit). FCC units typically are operated with a feedstock quality constraint of very low metals asphaltenes, and CCR (i.e., less than 10 wppm metals, less than 0.2 wt % asphaltenes, and less than 2 wt % CCR). Utilization of feedstocks with greater levels of asphaltenes or CCR results in increased coke production and a corresponding reduction in unit capacity. In addition, use of feedstocks with high levels of metals and asphaltenes results in more rapid deactivation of the catalyst, and thus increased catalyst consumption rates and increased catalyst replacement costs.

In U.S. Pat. No. 5,192,421, a process for the treatment of whole crude oil is disclosed, the process comprising the steps of deasphalting the crude by first mixing the crude with an aromatic solvent, and then mixing the crude-aromatic solvent mixture with an aliphatic solvent. The U.S. '421 patent (at page 9, lines 43–45) identifies that certain modifications must be made to prior art solvent deasphalting technologies, such as that described in U.S. Pat. Nos. 2,940,920, 3,005,769, and 3,053,751 in order to accommodate the process described in the U.S. '421 patent, in particular since the prior art solvent deasphalting technologies have no means to remove that portion of the charge oil that will vaporize concurrently with the solvent and thus contaminate the solvent used in the process. In addition to being burdened by the complexity and cost resulting from the use of two solvents, the U.S. '421 process results in a deasphalted product that still contains a non-distilled portion with levels of CCR and metals that exceed the desired levels of such contaminants.

In U.S. Pat. No. 4,686,028 a process for the treatment of whole crude oil is disclosed, the process comprising the steps of deasphalting a high boiling range hydrocarbon in a two-stage deasphalting process to produce separate asphaltene, resin, and deasphalted oil fractions, followed by upgrading only the resin fraction by hydrogenation or visbreaking. The U.S. '028 patent is burdened by the complexity and cost of a two-stage solvent deasphalting system to separate the resin fraction from the deasphalted oil, in addition, like the U.S. '421 patent, the '028 process results in an upgraded product that still contains a non-distilled fraction—the DAO—that is contaminated with CCR and metals.

In U.S. Pat. No. 4,454,023 a process for the treatment of heavy viscous hydrocarbon oil is disclosed, the process comprising the steps of visbreaking the oil; fractionating the visbroken oil; solvent deasphalting the non-distilled portion of the visbroken oil in a two-stage deasphalting process to produce separate asphaltene, resin, and deasphalted oil fractions; mixing the deasphalted oil with the visbroken distillates; and recycling and combining resins from the deasphalting step with the feed initially delivered to the visbreaker. The U.S. '023 patent is burdened by the complexity and cost of a two-stage solvent deasphalting system to separate the resin fraction from the deasphalted oil. In addition, the '023 process results in an upgraded product that still contains a non-distilled fraction—the DAO—that is contaminated with CCR and metals.

In U.S. Pat. No. 5,601,697 a process is disclosed for the treatment of topped crude oil, the process comprising the steps of vacuum distilling the topped crude oil, deasphalting the bottoms product from the distillation, catalytic cracking of the deasphalting oil, mixing the distillable catalytic cracking fractions (atmospheric equivalent boiling temperature of less than about 1100° F.) to produce products comprising transportation fuels, light gases, and slurry oil. The U.S. Pat. No. '697 is burdened by the complexity, cost, and technical viability of vacuum distilling a topped heavy crude to about 850° F. and catalytic cracking the deasphalted oil to produce transportation fuels. This level of upgrading is too complex and required too large of a scale to be useful for oil field applications, and U.S. Pat. No. '697 selectively eliminates the majority of the material that could be used as fuel for a combustion turbine or internal combustion engine without further upgrading.

It is therefore an object of the present invention to provide a new and improved method of and means for upgrading hydrocarbons containing metals and asphaltenes wherein the disadvantages as outlined are reduced or substantially overcome.

SUMMARY OF THE INVENTION

According to the present invention, a method of and means for upgrading a hydrocarbon containing metals and asphaltenes is provided, the method comprising the steps of: supplying the hydrocarbon containing metals and asphaltenes to a vaporizer present in a deasphalting unit and operating at, above, or below atmospheric pressure for heating and vaporizing the hydrocarbon at a temperature sufficient to vaporize at least that fraction of the hydrocarbon which has an atmospheric boiling temperature less than about 50° F. below the critical temperature of the solvent used in the deasphalting unit; removing and subsequently condensing the hydrocarbon fraction so vaporized from the balance of the hydrocarbon to be upgraded, prior to the addition of the solvent to the hydrocarbon; and processing the hydrocarbon remaining after the initial vaporization step in a solvent deasphalting unit such as that disclosed in copending U.S. patent application Ser. No. 08/862,437 filed on May 23, 1997, the disclosure of which is hereby included by reference, to produce atmospheric distillate, deasphalted oil (DAO) and asphaltenes.

Usually, the step of supplying the hydrocarbon to a vaporizer present in a deasphalting unit and operating at, above, or below atmospheric pressure for heating and vaporizing the hydrocarbon is carried out by supplying the hydrocarbon to a heater for heating the hydrocarbon and thereafter supplying the heated hydrocarbon to a fractionation column. If a prior art solvent deasphalting unit is used, all of the material boiling below an atmospheric equivalent temperature of about 450° F. will have to be removed in the vaporization step in order to prevent contamination of the solvent, and the SDA unit will produce only DAO and asphaltenes. In a preferred embodiment of the present invention, the DAO (or atmospheric DAO) is firstly fractionated in a fractionation column which may be a distillation column or flash vessel which may be included in the SDA unit to produce vacuum distillate (i.e., fractions with atmospheric equivalent boiling temperatures less than about 1100° F.) and non-distilled DAO residue (vacuum DAO), and the non-distilled DAO residue is heated for sufficient time and at suitable temperature conditions to thermally crack the non-distilled DAO residue into thermally cracked lighter, lower boiling range fractions (comprising thermally cracked fractions with atmospheric equivalent boiling temperatures less than about 1100° F.), and a thermal cracker residue fraction (thermal cracker residue, or TCR, comprising by-product asphaltenes, unconverted vacuum DAO, thermal cracker gases, etc. ); and fractionating the TCR in a further fractionation column operating at sub-atmospheric pressure to separate thermally cracked vacuum distillate fractions (i.e., fractions with atmospheric equivalent boiling temperatures in the range 650–1050° F.) from the non-distilled TCR. Note that throughout the text the term fractionating, column is used and is taken to mean a distillation column or flash vessel.

The distilled, thermally cracked and low boiling range fractions and the thermally cracked vacuum distillate are substantially asphaltene-free and metal-free and can be used, alone or re-combined with one or more of the distillate fractions obtained from the original feedstock, without further treatment, as a replacement for premium distillate fuels or refinery feedstocks.

According to the present invention, the TCR fraction can be substantially recycled and combined with the feed to the solvent deasphalting unit.

In the course of cracking the non-distilled DAO residue, asphaltenes are produced as a by-product of the thermal cracking process. Under severe thermal cracking conditions, such as would be employed to maximize the generation of lighter products, sufficient asphaltenes can be created in the thermal cracking step so as to cause precipitation of asphaltenes and fouling of the thermal cracker heater exchanger, or precipitation of the asphaltenes from the thermal cracker in subsequent storage or transport. The precipitation of asphaltenes thus produces a limit on the severity and yield of lighter, lower boiling range fractions and vacuum distillate fractions from the thermal cracking process.

According to the present invention, the asphaltenes present in the hydrocarbons to be upgraded are removed in the deasphalting step prior to the thermal cracking step. In addition, by recycling the TCR, which contains asphaltenes created as a by-product of the thermal cracking to the solvent deasphalting step, the thermal cracker-produced asphaltenes are removed from the TCR and the deasphalted TCR can be returned to the thermal cracker for further cracking. Thus, according to the present invention, the removal of asphaltenes from the initial and the recycled feedstocks to the thermal cracker allow for a much improved level of conversion of non-distilled hydrocarbon into distillates than is possible with the prior art.

Furthermore, in accordance with the present invention, the recycled TCR stream can be used to provide at least some of the heat required to achieve the desired temperature for the initial vaporization step of the process.

According to the present invention, the asphaltenes produced from the invention can be used as fuel by another fuel user. For example, these asphaltenes can be used as fuel in a fluidized bed combustor or high viscosity fuel oil boiler, or emulsified and used in as an alternative to heavy fuel oil in conventional systems. Alternatively, the asphaltenes can be used As fuel in a gasifier, or they can be cracked to produce lighter liquid fuels. If so cracked, the distillate fuel produced from the asphaltenes can be combined with the distillate products that result from the cracking of the DAO or from the fractionation of the original feedstock to the process.

In accordance with another embodiment of the present invention, the hydrocarbon to be upgraded can sometimes comprise non-distilled residue which contains metals, asphaltenes, and CCR, combined with a lower-boiling range hydrocarbon diluent to achieve a desired viscosity and density of the combined oil. Such diluent, if separated from the non-distilled residue, is a valuable fuel which requires no further processing. In the case of a non-distilled-heavy oil and diluent mixture, the invention would comprise of the steps of supplying the heavy oil or hydrocarbon mixture to a diluent vaporizer present in the deasphalting unit for heating and vaporizing the hydrocarbon at a temperature sufficient to vaporize or boil off the diluent and subsequently condensing the diluent; and processing the remaining distillation residue in the deasphalting unit as previously described. Usually the step of supplying the heavy oil or hydrocarbon mixture to a vaporizer present in a deasphalting unit for heating and vaporizing the diluent is carried out by supplying the heavy oil or hydrocarbon mixture to a heater for heating the heavy oil or hydrocarbon mixture and thereafter supplying the heated heavy oil or hydrocarbon mixture to a fractionation column.

In accordance with another embodiment of the invention, if the hydrocarbons to be upgraded contains a fraction that is distillable at an equivalent atmospheric boiling temperature less than about 50° F. below the critical temperature of the solvent used in the solvent deasphalting step, the invention can be used to simultaneously fractionate and deasphalt in one device to produce as separate products distillates, non-distillable deasphalted oil, and asphaltenes.

In a further embodiment of the invention, diluent, either from a deasphalting unit or from another source, can be added to the asphaltenes exiting the deasphalting unit to produce heavy fuel oil.

In another embodiment of the invention, if the invention is used at the site of a power generation system, such as a combustion turbine, to produce fuel for the power generation, system, then waste heat from the power generation unit can be used to provide at least some of the thermal energy required by the deasphalting or thermal cracking steps.

Furthermore, the present invention also comprises means or apparatus for carrying out the method or methods of the present invention. In an embodiment of means for upgrading hydrocarbons containing metals and asphaltenes in accordance with the present invention, apparatus comprises a heat exchanger and vaporizer contained in a deasphalting unit for heating the hydrocarbons to a temperature sufficient to vaporize at least that fraction of hydrocarbon which has an atmospheric boiling temperature less than about 50° F. below the critical temperature of the solvent used in the solvent deasphalting process and boiling off and subsequently condensing the fraction so vaporized; and means for supplying the remaining hydrocarbon to a deasphalting unit such as that disclosed in copending U.S. patent application Ser. No. 08/862,437 filed on May 23, 1997, for producing deasphalted oil DAO) and asphaltenes. If a prior art solvent deasphalting unit is used, all of the material boiling below an atmospheric equivalent temperature of about 450–650° F. will have to be removed in the vaporization step in order to prevent contamination of the solvent, and the SDA unit will produce only DAO and asphaltenes. In a preferred embodiment of the present invention, means for fractionating the resulting deasphalted oil under sub-atmospheric conditions are provided which may be included in the SDA unit, as well as means for thermally cracking and distilling the non-distillate residue of the DAO.

BRIEF DESCRIPTION OF THE DRAWINGS

Embodiments of the invention are described by way of example, and with reference to the accompanying drawings wherein:

FIG. 1A is a block diagram of one embodiment of a heavy oil upgrader according to the present invention;

FIG. 1B is a block diagram of a modified version of the embodiment of FIG. 1A;

FIG. 2B is a block diagram showing details of a further portion of the upgrader shown in FIG. 2A;

DETAILED DESCRIPTION

Figure 2A:
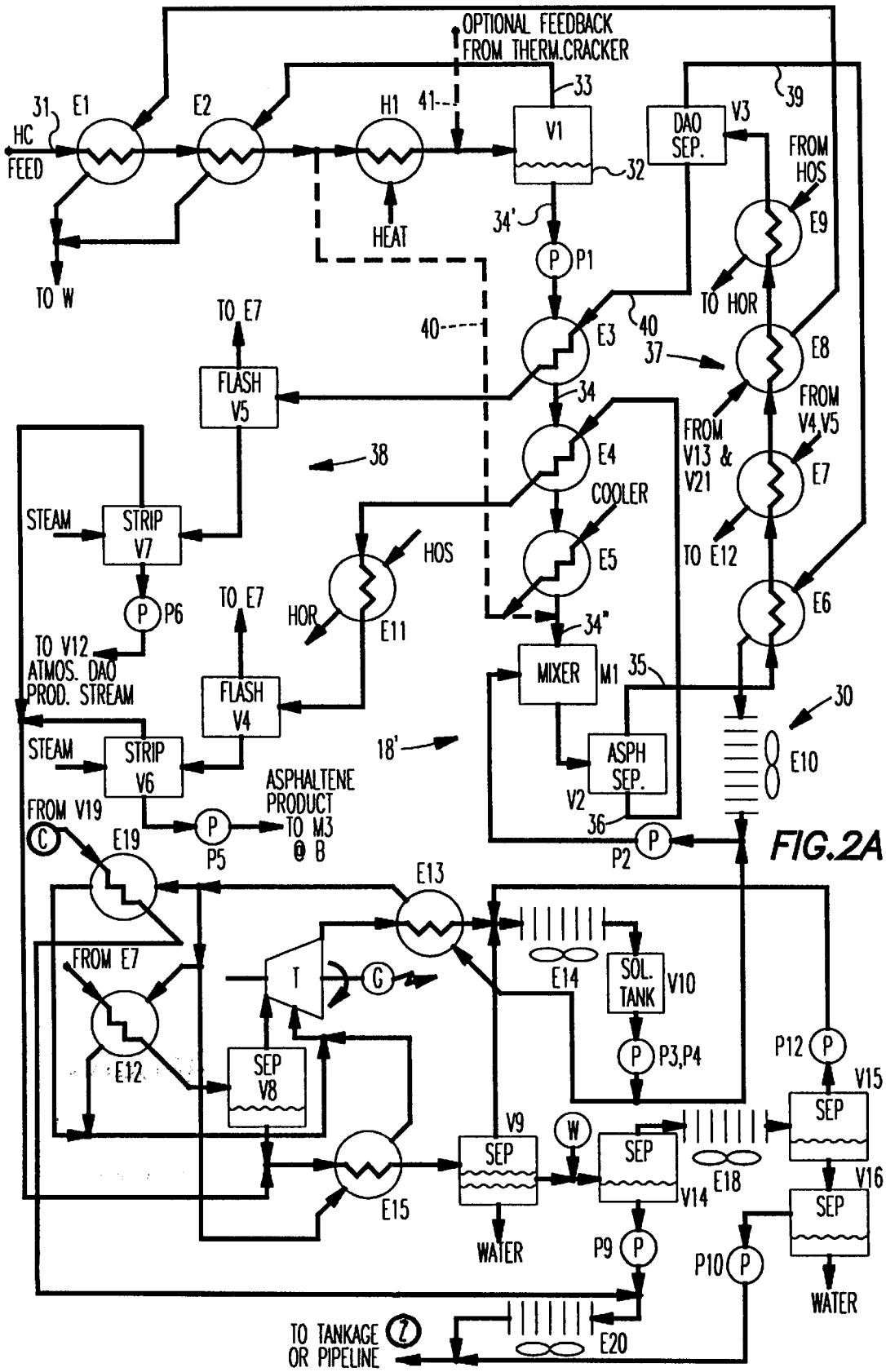
FIG. 2A is a block diagram showing details of the front-end and solvent deasphalting unit of a heavy oil upgrader according to the present invention.

Turning now to the drawings wherein like reference characters in the various figures designate like components, reference numeral 10A in FIG. 1A, and reference numeral 10B in FIG. 1B, designate embodiments of a heavy oil upgrader according to the present invention. Upgrader 10A functions to upgrade a source feed of crude oil, which is mainly heavy hydrocarbons but typically contains light fractions, heavy metals, asphaltenes, etc., to a plurality of valuable non-asphaltene product streams including atmospheric and vacuum distillates, etc., and to a less valuable asphaltene product stream that contains most of the metals, coke pre-cusors, etc. present in the source feed. Upgrader 10B in FIG. 1B functions to upgrade a source feed, such as atmospheric or vacuum residual, which lacks light fractions with atmospheric equivalent boiling temperatures below about 450° F.

An upgrader according to the present invention, utilizes a solvent deasphalting (SDA) unit 11 that employs a solvent having a critical temperature $T_c$, and includes fractionator 12 constructed as a distillation column, and arranged to separate from first hydrocarbon input stream 13, fractions with an atmospheric equivalent boiling temperature less than about $T_f^\circ$ F. for producing stream 14 of $T_f^-$ fractions (e.g., naphtha, atmospheric distillate, vacuum distillate, etc.) and residue stream 15 ($T_f^+$ stream), where $T_f$ is greater than about $T_c$–50° F. Typically, $T_f$ will be less than about 1100° F.

Figure 3:
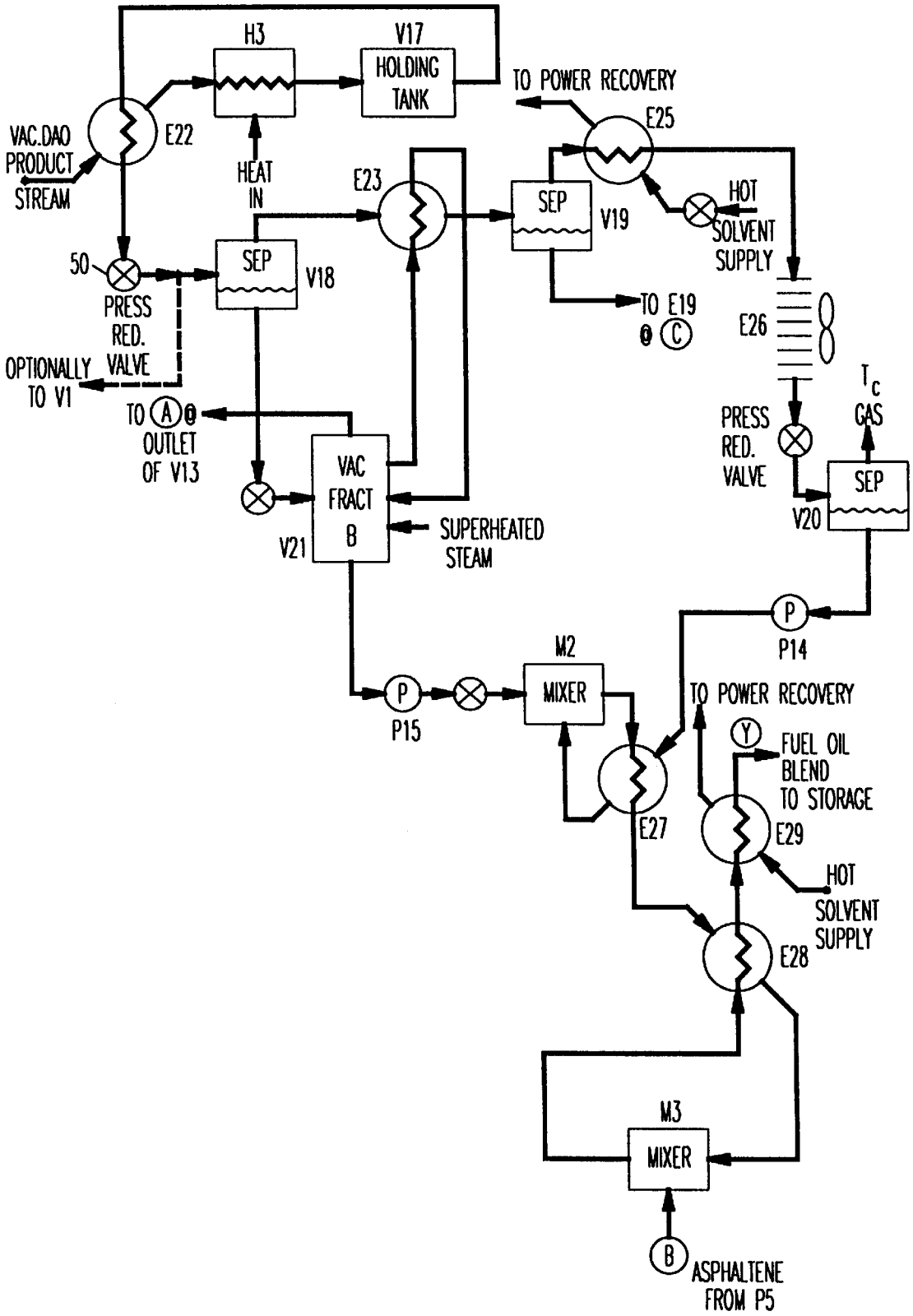
FIG. 3 is a block diagram showing details of a thermal cracker and other components of the upgrader shown in FIGS. 2A and 2B.

SDA unit 11, which may be either of conventional design, or constructed in accordance with the details shown in FIGS. 2A, 2B, and 3, deasphalts second hydrocarbon input stream 16, which includes residue stream 15, for producing first product stream 17 of substantially solvent-free asphaltenes, and second product stream 18 containing substantially solvent-free deasphalted oil (DAO).

Source feed 19A is included in first input stream 13 (FIG. 1A) when feed 19A contains fractions with an atmospheric equivalent boiling temperature less than about $T_f^\circ$ F. However, if source feed 19B contains no such fractions, then source feed 19B bypasses fractionator 12 and is included in the second input stream (FIG. 1B). Thus, the source feed is included in either the first or second input streams according to the nature of the source feed.

Second product stream 18 containing DAO is heated in heater 20 and then cracked in thermal cracker 21. The cracking operation that takes place in cracker 21 produces output stream 22 that includes thermally cracked fractions and by-product asphaltenes produced by thermally cracking the DAO. Stream 22 also contains unconverted DAO the level of which is dependent on the efficiency of conversion of thermal cracker 21.

At least some of the thermally cracked fractions in stream 22 are fed back through heat exchanger 23 to first input stream 13 supplying fractionator 12. The entire output stream may be fed back to allow fractionator 12 to separate all of the lighter fractions produced by the thermal cracking process, and to allow the SDA unit to separate by-product asphaltenes produced by the thermal cracking process.

Stream 14 of $T_f^-$ fractions produced by fractionator 12 is cooled prior to storage or use by passing this stream through heat exchanger 24 wherein heat contained in stream 14 is transferred to the source feed which is preheated in preparation either for removing light fractions (FIG. 1A), or for processing by SDA unit 11 (FIG. 1B). Note that in FIG. 1A, the first input stream consists of source feed 19A and output 22 of the thermal cracker, and the second input stream consists of residue stream 15. In FIG. 1B, the first input stream consists of output 22 of the thermal cracker, and the second input stream consists of source feed 19B and residue stream 15.

The upgraders shown in FIGS. 1A and 1B have a single input, namely, a hydrocarbon source feed, and two main products as outputs: a range of non-asphaltene product streams of valuable light fractions, and a less valuable asphaltene product stream. Thus, the upgraders of the present invention represent a particularly simple technological solution for upgrading heavy hydrocarbon feedstock to provide fuel for power generation, or feedstock for a refinery.

Preferably, the fractionator shown in FIG. 1A and FIG. 1B is integrated into an SDA unit to establish a new and improved upgrader designated by reference numeral 30 in FIGS. 2A, 2B and 3. Referring first to FIG. 2A, upgrader 30 receives hydrocarbon feed 31, such as crude oil usually containing light fractions, which if not removed upstream of SDA unit 18', adversely affect the operation of the SDA unit due to the trapping of the light fractions in the solvent. The feed is heated in passing through serially disposed heat exchangers E1 and E2 (which correspond to heat exchanger 24 in FIG. 1A), and H1 to about 450° F. and applied to fractionator V1 which produces a stream of atmospheric distillate (i.e., fractions such as naphtha with atmospheric equivalent boiling temperatures less that about 450° F.) which passes out the top of the fractionator. The stream of atmospheric distillate flows through conduit 33 and is cooled by transferring heat to feed 31 in heat exchanger E2 forming a product stream in conduit 33'. Residue 32 passes out the bottom of fractionator V1. Because this residue is what remains in the fractionator after atmospheric distillate is removed, thus residue is referred to as atmospheric residue for reference purposes.

In order to utilize a solvent deasphalting process to separate asphaltenes in residue 32, the temperature of the residue must be reduced from that of the fractionator V1 to about $T_c$ where $T_c$ is the critical temperature of he solvent prior to mixing the residue with a solvent. To this end, the residue is pumped through conduit 34 by pump P1 at the outlet 34' of fractionator V1, to inlet 34" of mixer M1 after passing through serially disposed heat exchangers E3, E4 and E5. If feed 31 is vacuum resid, heat exchangers H1, E3, E4, and E5 would be by-passed, and the feed exiting heat exchanger E2 would be applied directly to input 34" of mixer M1 as indicated by chain line 40.

Mixer M1 mixes the cooled residue from fractionator V1 with a solvent (e.g., liquid pentane), and the mixture is applied to asphaltene separator V2 wherein gravity separates the mixture into lighter deasphalted oil (DAO) and heavier asphaltenes. Through conduit 35 at the top of the separator flows a mixture stream of DAO and solvent, and through conduit 36 at the bottom flows a mixture stream of asphaltenes and solvent in which a small amount of DAO is dissolved.

A product stream of substantially solvent-free DAO (termed atmospheric DAO product stream because atmospheric distillate has been removed upstream of SDA unit 18') is produced by SDA 18' by sequentially applying the mixture of DAO and solvent in conduit 35, first to supercritical solvent recovery section 37, and then to evaporative solvent recovery section 38. A product stream of substantially solvent-free asphaltene is also produced by SDA 18 by applying the asphaltene and solvent mixture, directly to evaporative solvent recovery section 38.

Section 37 includes serially disposed heat exchangers E6-9 associated with conduit 35 so that the stream of DAO and solvent produced by separator V2 is heated to above the critical temperature of the solvent before reaching DAO separator V3 of section 37. In this separator, phase separation of the fluid takes place producing a stream of solvent that flows out the top of separator V3 into conduit 39, and a mixture of DAO and reduced solvent that flows out the bottom of the separator into conduit 40.

The temperature of the stream of solvent leaving separator V3 is above the critical temperature of the solvent and must be cooled before it can be recycled to mixer M1. Preferably, the stream of hot solvent is cooled by passing it through heat exchanger E6 and cooler E10 in preparation for recovering and then recycling the solvent to mixer M1. Thus, some of the heat added to the stream of DAO and solvent in conduit 35 to raise the temperature of the stream to above the critical temperature of the solvent is recovered in heat exchanger E6 by cooling the hot solvent from separator V3. Further cooling of the solvent to the desired temperature for use in mixer M1 is effected by condenser E10 whose operation is controlled to achieve the desired final temperature at the outlet of pump P2 which supplies solvent to mixer M1.

The temperature of the stream of DAO and reduced solvent leaving separator V3 through conduit 40 at the bottom of the separator is also above the critical temperature and pressure of the solvent. In preparation for flashing this stream in flash drum V5 in evaporative section 38, which evaporates the reduced solvent and produces a substantially solvent-free product steam of atmospheric DAO, the stream of DAO and reduced solvent is further heated in heat exchanger E3 by transferring heat from the residue flowing from fractionator V1. Thus, some of the heat added to the stream in conduit 31 by heater H1 is recovered by heat exchanger E3.

In a similar manner, the stream of asphaltene and solvent mixture in conduit 36 produced by separator V2, which is cooler than the DAO and reduced solvent stream in conduit 40 produced by separator V3, is heated in preparation for flashing this stream in flash drum V4 of evaporation section 38. First, the stream in conduit 36 passes through heat exchanger E4 downstream of heat exchanger E3 extracting heat from residue 32 produced by fractionator V1. The thus preheated stream is further heated in heat exchanger E11 supplied with hot fluid (preferably hot DAO product from hot oil supply HOS, FIG. 2B).

In parallel operations in section 38, the stream of DAO and reduced solvent leaving heat exchanger E3 is flashed in drum V5, and the stream of asphaltene and solvent leaving heat exchanger E11 is flashed in drum V4 producing vaporized solvent that is applied to heat exchanger E7 wherein the DAO and solvent stream in conduit 35 is heated. The residues produced by the flash drums are respectively applied to strippers V6 and V7 wherein, with the aid of injected steam and reduced pressure, a substantially solvent-free product stream of atmospheric DAO is produced at the bottom of stripper V7, and a substantially solvent-free product stream of asphaltene is produced at the bottom of stripper V6.

Before describing the further processing of these two product steams, the disposition of the vaporized solvent produced by flash drums V4 and V5, and of the mixture of vaporized solvent and steam produced by strippers V6 and V7 is described. After the vaporized solvent produced by drums V4 and V5 is cooled somewhat in heat exchanger E7, the solvent may still be too hot for proper expansion in an organic turbine. As a consequence, the solvent is further cooled in heat exchanger E12 (which preheats solvent pumped by pump P3,P4 from solvent storage tank V10); and the cooler vaporized solvent is applied to separator V8 for the purpose of separating any atmospheric distillate trapped in the solvent.

Vaporized solvent exits from the top of separator V8 and is applied to the inlet stage of organic vapor turbine T wherein expansion occurs driving generator G and producing power. Heat depleted solvent at lower pressure is exhausted from this turbine, cooled in heat exchanger E13 (which preheats solvent pumped by pump P3,P4 from solvent storage tank V10) to remove some of the superheat from the heat-depleted turbine exhaust, and then condensed in air-cooled condenser E14 producing liquid solvent that is stored in tank V10.

The fluid that exits from the bottom of separator V8 comprises atmospheric distillate and a residual amount of solvent. To this fluid is added the solvent and steam from he overhead of strippers V6 and V7; and the combined fluid, a mixture of atmospheric distillate, solvent, and steam flows though heat exchanger 15 to separator V9). Cooling of the fluids in heat exchanger E15 causes the steam and atmospheric distillate to condense in separator V9. The lower layer of liquid in the separator is water which is drained from the bottom, and the upper layer is a liquid comprising atmospheric distillate and perhaps some naphtha and condensed solvent, which flows to point W upstream of separator V14. Most of the solvent in separator V9 remains vaporized and is delivered to solvent condenser E14.

As indicated above, pumps P3,P4 also deliver make-up solvent to mixer M1 via pump P2. Condenser E10 is operated at a level that will establish the appropriate temperature for the solvent applied by pump P2 to mixer M1 taking into account the temperature of the solvent in tank V10, and the temperature of the solvent exiting heat exchanger E6. In addition to supplying make-up solvent to mixer M1, pumps P3, P4 also supply solvent from tank V10 to an intermediate stage of turbine T along three parallel paths. In one path, the solvent is heated by passing through heat exchangers E13 and E12. In a second path, solvent is heated by passing through heat exchanger E13 and heat exchanger E19 whose function is to cool atmospheric distillate produced downstream of the SDA unit by a thermal cracking operation described below. In a third path, the solvent is heated by passing through heat exchangers E13 and E15. Thus, the turbine will generate additional power using heat extracted from the solvent in the turbine exhaust prior to condensation, from the solvent produced by flash drums V4 and V5, strippers V6 and V7, and from atmospheric distillate produced by the SDA unit and the thermal cracker that is downstream of the SDA unit.

The mixture of liquids at point W arriving from separator V9 is joined by the distillate that passes through heat exchanger E2, and distillate (produced by the downstream thermal cracking operation) that passes through heat exchanger E1. This combined stream is applied to separator V14 wherein, at a reduced pressure, the lighter fractions vaporize and pass out the top of the separator. The vapor passing out the top of separator V14 is vaporized solvent, steam, and naphtha. This vapor is cooled in condenser E18 and supplied to separator V15 in which the water and naphtha separate from the solvent which remains a vapor and is returned by pump P12 to solvent condenser E14. The naphtha and steam are separated from each other in separator V16, the water being drawn from the bottom of this separator. The naphtha is pumped at P10 to point Z where it is combined with liquid atmospheric distillate from the bottom of separator 14, and with vacuum distillate produced by the thermal cracker downstream of SDA unit 18' to produce a finished product stream that is supplied to tankage or pipeline.

As described above, the apparatus shown in FIG. 2A receives a hydrocarbon feed at 31, and produces the following: a product stream of substantially solvent-free atmospheric DAO at the output of stripper V7, a product stream of substantially solvent-free asphaltene at the output of stripper V6; and, at point Z, a product stream that is a blend of virgin atmospheric and vacuum distillates and naphtha (i.e., fractions present in the original feed), as well as atmospheric and vacuum distillates and naphtha produced by the thermal cracking process applied to the DAO product stream.

Pump P6 at the outlet of stripper V7 delivers the atmospheric DAO product stream to holding tank V12 as shown in FIG. 2B to which reference is now made. Tank V12 is at ambient temperature, and any solvent or light noncondensable gases in the DAO are removed from the overhead of this tank and burned with additional fuel to heat DAO from tank V12 delivered by pump P7 to heater H2. Some of the hot DAO produced by heater H2 is supplied to heat exchanger E9 in supercritical section 37 of the SDA unit (FIG. 2A) and to heater H1 upstream of fractionator V1 (FIG. 2A). Because the hot DAO used as a heat exchange fluid is constantly renewed by the SDA unit, the quality of the heat exchange fluid supplied to the SDA unit for heating does not deteriorate over time. This technique is disclosed in co-pending application Ser. No. 08/710,545 filed Sep. 19, 1996, the disclosure of which is hereby incorporated by reference.

The bulk of the hot DAO, however, is supplied to vacuum fractionator V13 which produces at its overhead, a stream of fractions with atmospheric equivalent boiling temperatures less than about 1100° F. (vacuum distillate), and which at its bottom, produces a residue stream that is termed vacuum DAO (i.e., DAO that remains after vacuum distillate is removed). The vacuum distillate produced by fractionator V13 is cooled in heat exchanger E8 (FIG. 2A) which helps raise the DAO and solvent mixture from the asphaltene separator to the supercritical temperature of the solvent, and then further cooled in heat exchanger E1 (FIG. 2A) which helps raise the temperature of feed 31 upstream of fractionator V1.

The product stream of vacuum DAO is supplied by pump P13 to heat exchanger E22 (FIG. 3) wherein the stream is preheated, and then to heater H3 wherein the temperature of the stream is raised to about 900° F. From this heater, the hot DAO flows to holding tank V17 of a size that provides sufficient residence time for thermal cracking of the DAO to take place. The thermally cracked stream produced by thermal cracker V17 comprises fractions with atmospheric equivalent boiling temperatures ranging through about 1100° F., by-product asphaltenes produced by the thermal cracking process, unconverted vacuum DAO, thermal cracker gas, etc. all at about 900° F. This hot thermally cracked stream is cooled by passing through heat exchanger E22 which serves to heat the stream of vacuum DAO from fractionator V13 (FIG. 2B) being supplied to the thermal cracker.

After passing through pressure reducer valve 50, some or all of the somewhat cooled thermally cracked stream may be supplied to the input to fractionator V1 as indicated by broken line 41 in FIG. 2A. In such case, the lighter fractions in the thermally cracked stream would be recovered from the overhead of fractionator V1, and the remaining portion of the thermal cracked stream, namely by-product asphaltenes, heavier fractions, and the unconverted DAO being part of the residue that passes out the bottom of fractionator V1. Preferably, however, recovery of the lighter fractions produced by the thermal cracking process takes place without feeding back the thermally cracked stream to the input 31 of the upgrader.

As shown in FIG. 3, the cooled, and pressure reduced thermally cracked stream is applied to separator V18 which produces two streams: at its overhead, a stream of thermal cracker atmospheric distillate (fractions with atmospheric equivalent boiling temperatures less than about 650° F. and gases) produced by the cracking process; and at its bottom, a stream of thermal cracker atmospheric residue (i.e., a stream of that which remains after atmospheric distillate is removed from the thermally cracked feed to the separator). The fluid flowing out the overhead of this separator is further cooled in heat exchanger E23 before entering separator V19 which serves to separate the feed into a vapor stream containing some atmospheric distillate and gas, and a liquid stream containing atmospheric distillate all produced by the thermal cracking process. The liquid stream of atmospheric distillate from separator V19 is supplied to heat exchanger E19 (FIG. 2A) where cooling takes place before this stream is delivered to condenser E20 to join the virgin atmospheric distillate contained in feed 31.

The vapor stream from separator V19 may be cooled in heat exchanger E25 for the purpose of preheating solvent for application to turbine T, and then condensed in condenser E26. After pressure reduction in a reducer valve, the overhead fluid from separator V19 flows to separator V20 which allows the non-condensable gases produced by the thermal cracking process to be drawn out the overhead of this separator and supplied, for example, to heater H2. The bottom fluid from separator V20, atmospheric distillate produced by the thermal cracking process, is delivered by pump P14 to heat exchanger E27 where it cools the output of mixer M2 before being an input to this mixer.

The other input to mixer M2 is the heaviest portions of the thermal cracker atmospheric residue stream produced at the bottom of separator V18. Such stream is applied to vacuum fractionator V21 which produces two streams: at its overhead, a stream of thermal cracker vacuum distillate (i.e., fractions with atmospheric equivalent boiling points in the range 650–1000° F.) produced by the thermal cracking process; and at its bottom, a stream of thermal cracker vacuum residue (i.e., a stream of that which remains after vacuum distillate is removed from the thermal cracker atmospheric residue feed to the separator). The thermal cracker vacuum residue contains by-product asphaltenes, unconverted DAO, etc. Superheated steam may be injected into separator V21 to assist in the fractionation process.

Pump P15 delivers a stream of thermal cracker vacuum residue to mixer M2 wherein the stream is mixed with thermal cracker atmospheric distillate to produce a mixture that is cooled in heat exchanger E27, and heated as needed in heat exchanger E28 before being delivered to mixer M3. In this mixer, the heated mixture is combined with virgin asphaltenes in feed 31 delivered to mixer M3 by pump P5 at the outlet of stripper V6 (FIG. 2A) of evaporation section 38 of SDA unit 18'. The output of mixer M3 is a fuel oil blend that is comparable to conventional fuel oil produced by refineries by blending diesel fuel with the asphaltene product produced by an SDA unit.

The present invention also contemplates other uses for the thermal cracker atmospheric distillate produced at the overhead of separator V18, the thermal cracker atmospheric esidue produced at the bottom of separator V18, and the vacuum thermally cracked stream, and the thermal cracker vacuum residue produced at the bottom of fractionator V21. For example, instead of producing a fuel oil blend, these components can be used to produce asphalt cement or asphalt cement binder.

The upgrader shown and described in FIGS. 2A, 2B, and 3 receives crude oil at its input at 31, and produces at point Z valuable light hydrocarbons (e.g., naphtha, virgin and thermal cracker produced atmospheric distillates, and virgin and thermal cracker produced vacuum distillates) for tankage or pipeline utilization, and at point Y, a fuel oil blend of the heavy residual material that remains after the valuable light hydrocarbons are removed from the feed. However, instead of storing or transporting the valuable light hydrocarbons produced by the upgrader apparatus, they may be directly used for power generation purposes as illustrated in FIGS. 4A, 4B, 5, 6 and 7.

Figure 4A:
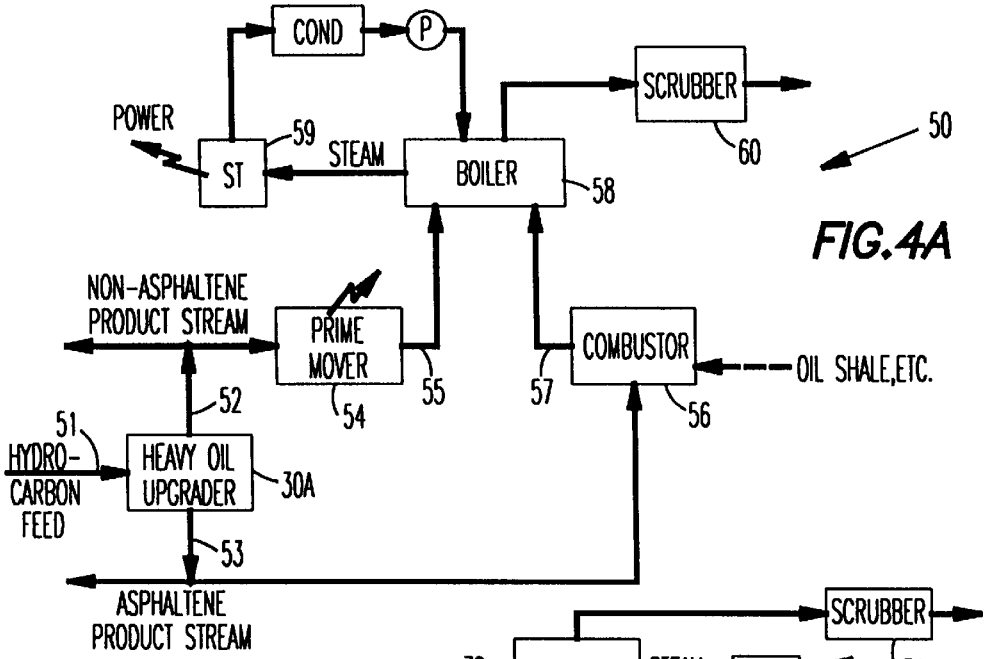
FIG. 4A is a block diagram of one embodiment of a power plant incorporated into an upgrader according to the present invention.

In apparatus 50 shown in FIG. 4A, upgrader 30A is constructed in accordance with the present invention and receives hydrocarbon feed 51 which may be crude oil, vacuum resid from a refinery, or other heavy hydrocarbon. Upgrader 30A produces two main outputs from this single input: non-asphaltene product stream 52, which comprises light, valuable hydrocarbons (e.g., atmospheric and vacuum distillates, etc.) produced as described above, and asphaltene product stream 53. Some or all of stream 52 is piped to prime mover 54 which may be, for example, an internal combustion engine such as a diesel engine, gas engine, or a gas turbine, etc., coupled to a generator (not shown) for generating power by using stream 52 as a fuel and producing hot exhaust gases in conduit 55.

Some or all of asphaltene stream 53 is directed to combustor 56 wherein combustion takes place producing hot products of combustion in conduit 57. Both all, or some of the exhaust from the prime mover and the hot products of combustion from the combustor are applied to steam boiler 58 which generates steam that is applied to steam turbine 59 for generating additional power. The heat depleted gases that exit the steam boiler are conveyed to a stack which may contain scrubber 60 that removes environmentally deleterious components such as sulfur before the heat depleted gases are vented to the atmosphere.

Figure 4B:
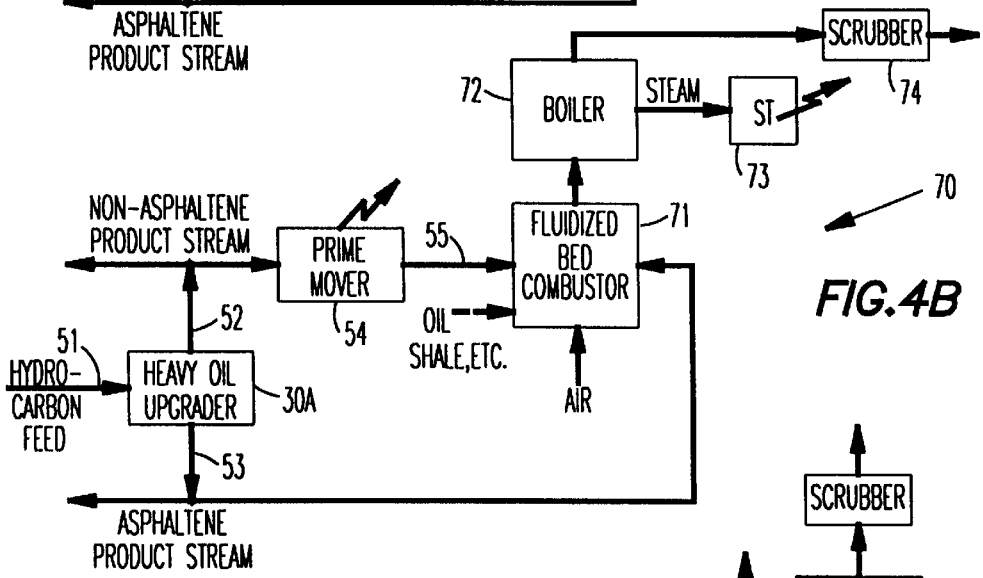
FIG. 4B is a block diagram of a modified version of the embodiment of FIG. 4A.

In apparatus 70 shown in FIG. 4B, upgrader 30A is constructed in accordance with the present invention and receives hydrocarbon feed 51 which may be crude oil, vacuum resid from a refinery, or other heavy hydrocarbon. Upgrader 30A produces two main outputs from this single input: non-asphaltene product stream 52, which comprises light, valuable hydrocarbons (e.g., atmospheric and vacuum distillates, etc.) produced as described above, and asphaltene product stream 53. Some or all of stream 52 is piped to prime mover 54 which may be, for example, an internal combustion engine such as a diesel engine, gas engine, or a gas turbine, etc., coupled to a generator (not shown) for generating power by using stream 52 as a fuel and producing hot exhaust gases in conduit 55.

All or some of the exhaust gases are applied to fluidized bed combustor 71 (which, if preferred, may be a spouted bed combustor) as combustion air, or as a fluidizing medium, or as both as combustion air and as a fluidizing medium. The fuel for combustor 71 is the asphaltene in stream 53 produced by the upgrader. The hot combustion gases produced by the fluidized bed combustor are applied to steam boiler 72 which generates steam that is applied to steam turbine 73 which generates additional power. The heat depleted gases that exit the steam boiler are conveyed to a stack which may contain scrubber 74 that removes environmentally deleterious components such as sulfur before the heat depleted gases are vented to the atmosphere.

Figure 5:
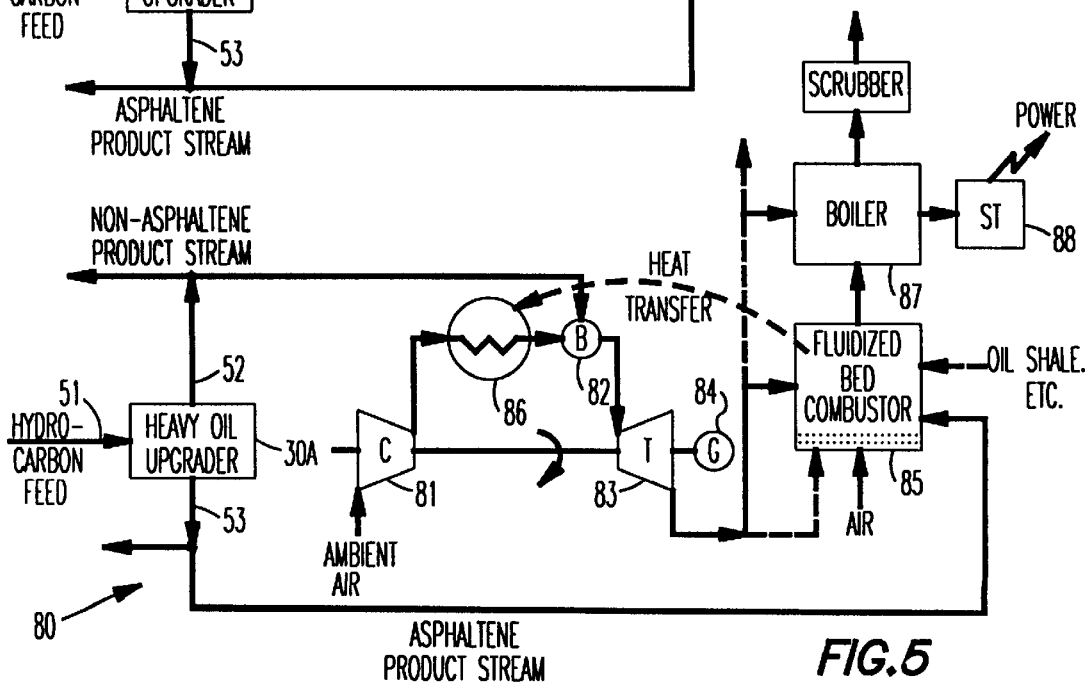
FIG. 5 is a block diagram of a further embodiment of a power plant incorporated into an upgrader according to the present invention.

In apparatus 80 shown in FIG. 5 is a variant of the apparatus shown in FIG. 4B in that FIG. 5 shows gas turbine unit 54A as the prime mover. Unit 54A includes compressor 81 for compressing ambient air and producing a compressed air stream that is applied to burner 82 in which is burned a non-asphaltene product from the upgrader. Burner 82 produces a heated stream of gas that is applied to turbine 83 coupled to generator 84. The heated stream of gas expands in turbine 83 driving the generator and producing power and exhaust gases. All or some of these exhaust gases are supplied to fluidized bed combustor 85 as a fluidizing medium and/or combustion air to support the combustion of asphaltene product produced by the upgrader.

Heat exchanger 86 interposed between compressor 81 and burner 82 is operatively associated with combustor 85 (which may be a fluidized bed combustor, or spouted bed combustor) for transferring heat from the combustor to the compressed air stream produced by the compressor. The hot combustion gases produced by combustor 84 are applied to steam boiler 87 which generates steam that is used by steam turbine 88 to generate additional power. The heat depleted gases that exit the steam boiler are conveyed to a stack which may contain scrubber 89 that removes environmentally deleterious components such as sulfur before the heat depleted gases are vented to the atmosphere.

Figure 6:
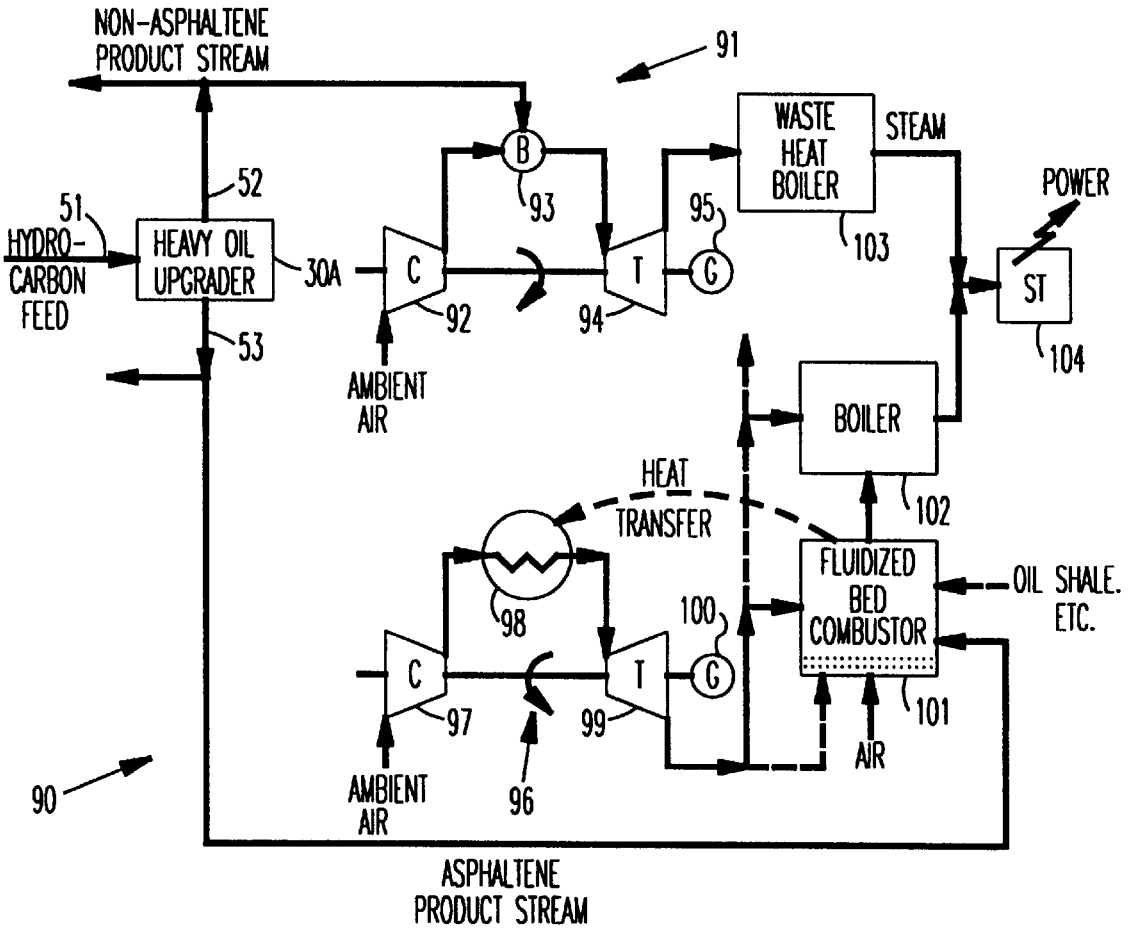
FIG. 6 is a block diagram of a still further embodiment of the present invention.
Figure 7:
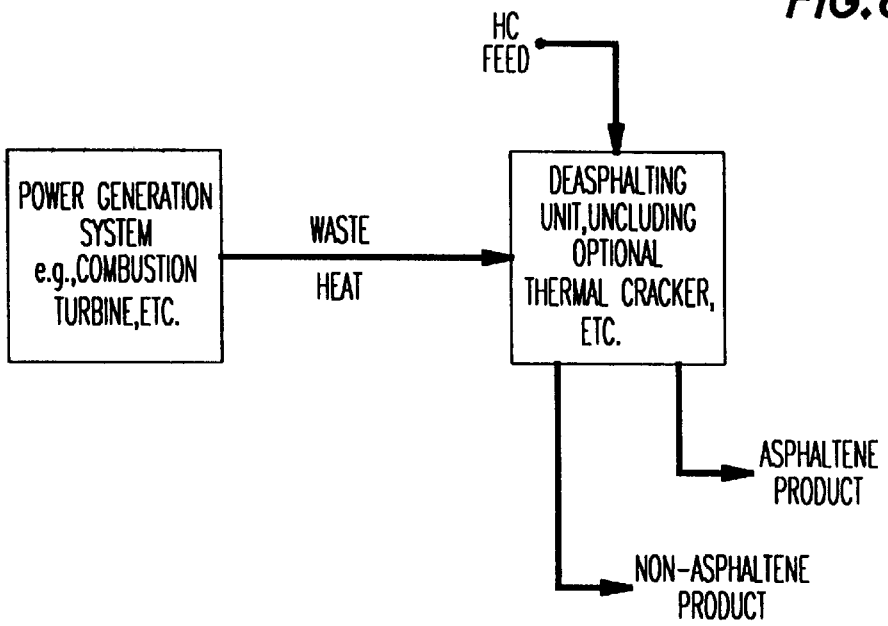
FIG. 7 is a schematic showing of the use of waste heat in a conventional power generation system for supplying heat to an upgrader according to the present invention.

In apparatus 90 shown in FIG. 6, both an air turbine and a gas turbine are the prime movers that use the non-asphaltene product stream produced by upgrader 30A. Gas turbine unit 91 of apparatus 90 includes compressor 92 for compressing ambient air and producing a compressed air stream, and burner 93 to which the compressed air stream is supplied and to which is supplied a non-asphaltene product from the upgrader. Burner 93 heats the air producing a heated stream of gas that is applied to gas turbine 94 coupled to generator 95. The heated stream of gas expands in turbine 94 which drives the generator producing power and exhaust gases which are applied to waste heat boiler 103 for producing steam.

Apparatus 90 also includes air turbine unit 96 having compressor 97 for compressing ambient air and producing a compressed air stream, and heat exchanger 98 for heating the air and producing a heated stream of air. Air turbine 99 coupled to generator 100 is responsive to the heated stream of air for driving the generator and producing power and a heat-depleted stream of air. Combustor 101, configured as a fluidized bed combustor, or spouted bed combustor, combusts asphaltenes from the product stream of asphaltenes produced by said upgrader, and produces combustion gases.

Heat exchanger 98 is operatively associated with and responsive to combustor 101 for supplying heat to the air stream compressed by compressor 97. As indicated, the heat-depleted stream of air exhausted by turbine 99 supplies all, or some of the air for fluidizing the combustor. Finally, steam boiler 102 is responsive to the combustion gases from the combustor for generating steam, which together with steam from waste heat boiler 103, is supplied to steam turbine 104 for generating additional power.

Optionally, oil shale, low grade coal, or other material, e.g., limestone, containing substantial amounts of calcium carbonate, can be combusted in the combustors shown in FIGS. 4A, 4B, 5, and 6 for effecting the capture of sulfur compounds in the asphaltene product stream burned in the various combustors. In a further embodiment of the invention shown in FIG. 7, waste heat produced by a power generating system, such as a system that includes a prime mover such as a combustion turbine, and/or internal combustion engines (e.g., diesel engine, gas engine, etc.), or a combined cycle system having a steam turbine, can be utilized to provide process heat for a conventional solvent easphalting unit, or for the upgraders disclosed in this application.

When gases from the prime mover are added to the combustor or steam boiler, pollutants (e.g., sulfur, etc.) of both streams can be treated using a common system, e.g., by adding limestone, oil shale, low grade fuel, etc. to the combustor. In such a manner, sulfur rich fuel can be used in the gas turbine, the sulfur being treated in the combustor to which all or a portion of the exhaust gases of the gas turbine are added.

The advantages and improved results furnished by the method and apparatus of the present invention are apparent from the foregoing description of the preferred embodiments of the invention. Various changes and modifications may be made without departing from the spirit and scope of the invention as described in the appended claims.

We claim:

1. A method for upgrading a hydrocarbon source feed using a solvent deasphalting (SDA) unit employing a solvent having a critical temperature $T_c$, said method comprising:

a) separating from a first hydrocarbon input stream fractions with an atmospheric equivalent boiling temperature less than about $T_f$° F. for producing a stream of $T_f^-$ fractions and a residue stream ($T_f^+$ stream), where $T_f$ is greater than about $T_c$−50° F.;

b) de-asphalting, in said SDA unit, a second hydrocarbon input stream which includes said residue stream for producing a first product stream of substantially solvent-free asphaltenes, and a second product stream containing substantially solvent-free deasphalted oil (DAO);

c) including said source feed in said first or second input streams;

d) thermally cracking the DAO in said second product stream for producing an output stream that includes thermally cracked fractions and by-product asphaltenes produced by thermally cracking the DAO; and e) including at least some of said thermally cracked fractions in said first input stream.

2. A method according to claim 1 wherein at least some of said by-product asphaltenes are included in said first input stream.

3. A method according to claim 1 wherein at least some of said output stream is included in said first input stream.

4. A method according to claim 1 wherein said source feed is included in said first input stream if said source stream contains fractions with an atmospheric equivalent boiling temperature less than about $T_f$° F.

5. A method according to claim 1 wherein said source feed is included in said second input stream if said source stream contains no fractions with an atmospheric equivalent boiling temperature less than about $T_f$° F.

6. A method according to claim 1 wherein said stream of $T_f^-$ fractions is separated from said first input stream by heating said first input stream to about $T_f$° F. to form a heated first input stream and then fractionating said heated first input stream, and cooling said stream of $T_f^-$ fractions by heating said source feed with said stream of $T_f^-$ fractions.

7. A method for processing a hydrocarbon feed comprising:

a) heating and then fractionating said hydrocarbon feed to produce a stream of fractions with an atmospheric equivalent boiling temperature less than $T_f$° F. for producing a stream of $T_f^-$ fractions and a residue stream ($T_f^+$ stream);

b) cooling said $T_f^+$ stream to form a cooled stream;

c) mixing a solvent with said cooled stream for effecting separation of the cooled stream into a stream of deasphalted oil (DAO) and solvent, and a stream of asphaltenes and solvent; and d) cooling of said $T_f^+$ stream being effected by exchanging heat between said stream of DAO and solvent, and said $T_f^+$ Stream, and between said stream of asphaltenes and solvent and said $T_f^+$ stream.

8. A method for processing a hydrocarbon feed containing no fractions with atmospheric equivalent boiling temperatures less than about 450° F. comprising:

a) mixing a solvent with said hydrocarbon feed for effecting separation of the feed into a stream of deasphalted oil (DAO) and solvent, and a stream of asphaltenes and solvent;

b) heating said stream of DAO and solvent with a heat transfer fluid until supercritical conditions are reached and the stream separates into two portions, a portion containing solvent and a small amount of DAO, and a portion containing DAO and reduced solvent;

c) heating said portion containing DAO and reduced solvent with a heat transfer fluid for forming a heated DAO product stream;

d) fractionating said heated DAO product stream to separate fractions with atmospheric equivalent boiling temperatures less than about 1100° F. for producing a stream of vacuum distillate fractions and a residue stream of vacuum DAO product; and e) wherein said stream of vacuum distillate fractions constitutes at least one of said heat transfer fluids.

9. A method for upgrading a hydrocarbon source feed using a solvent deasphalting (SDA) unit employing a (solvent having a critical temperature $T_c$, said method comprising:

a) separating from a first hydrocarbon input stream fractions with an atmospheric equivalent boiling temperature less than about 450° F. (atmospheric distillates) for producing a $450^-$ fraction stream and a $450^+$ residue stream;

b) de-asphalting a second hydrocarbon input stream which includes said $450^+$ residue stream, using a solvent for producing a first product stream of substantially solvent-free asphaltenes, and a second product stream containing substantially solvent-free deasphalted oil (atmospheric DAO stream);

c) including said source feed in said first or second input streams;

d) heating said atmospheric DAO stream to form a heated atmospheric DAO streams;

e) separating from said heated atmospheric DAO stream, a stream of fractions having atmospheric equivalent boiling temperatures less than about 1100° F. (vacuum distillate fractions), and a residue stream of vacuum DAO;

f) thermally cracking said residue stream of vacuum DAO for producing an output stream that includes thermally cracked fractions with an atmospheric equivalent boiling temperature less than about 1100° F. and by-product asphaltenes produced by thermally cracking said residue stream of vacuum DAO; and g) fractionating said output stream to separate therefrom fractions with atmospheric equivalent boiling temperatures less than about 1100° F. for producing a vacuum residue stream that includes said by-product asphaltenes.

10. A method according to claim 9 including blending lighter fractions with said vacuum residue stream to form a blended fuel.

11. A method according to claim 9 including causing said vacuum residue stream to be included with one of said input streams.

12. Apparatus for upgrading a hydrocarbon source feed, comprising:

a) a fractionator for receiving a first hydrocarbon input stream and separating the same into fractions with an atmospheric equivalent boiling temperature less than about $T_f°$ F. ($T_f^-$ fractions) thereby producing a product stream that consists of $T_f^-$ fractions, and a residue stream ($T_f^+$ stream);

b) a solvent deasphalting (SDA) unit utilizing a solvent having a critical temperature $T_c$ for receiving a second hydrocarbon input stream which includes said residue stream for producing a first product stream of substantially solvent-free asphaltenes, and a second product stream containing substantially solvent-free deasphalted oil (DAO), and wherein $T_f$ is greater than about $T_c$–50° F., such that said source feed is included in said first or second input streams; and c) a thermal cracker for thermally cracking the DAO in said second product stream for producing an output stream that includes thermally cracked fractions and by-product asphaltenes produced by thermally cracking the DAO, whereby at least some of said thermally cracked fractions are fed back to said first input stream.

13. Apparatus according to claim 12 wherein said means for including said source feed is constructed and arranged to include said source feed in said second input stream when said source stream contains fractions with an atmospheric equivalent boiling temperature less than about $T_f°$ F.

14. Apparatus according to claim 12 wherein said means for including said source feed is constructed and arranged to include said source feed in said first input stream when said said source stream contains no fractions with an atmospheric equivalent boiling temperature less than about $T_f°$ F.

15. Apparatus according to claim 12 including:

a) a prime mover operating on a non-asphaltene product stream produced by said apparatus for generating power and producing exhaust gases;

b) a combustor for combusting asphaltenes from said product stream of asphaltenes produced by said apparatus, and producing combustion gases;

c) a waste heat boiler responsive to said combustion gases for generating steam; and d) a steam turbine responsive to said steam for producing power.

16. Apparatus according to claim 15 wherein said waste heat boiler is responsive to said exhaust gases as well as said combustion gases for generating steam.

17. Apparatus according to claim 15 wherein said combustor is a fluidized bed combustor.

18. Apparatus according to claim 15 wherein said prime mover is a gas turbine unit having a compressor for compressing ambient air and producing a compressed air stream, a burner to which said compressed air stream is supplied and to which is supplied said non-asphaltene product from said apparatus for heating the air and producing a heated stream of air, and a gas turbine responsive to said heated stream of air for generating power and producing exhaust gases, whereby said exhaust gases are supplied to said combustor.

19. Apparatus according to claim 18 including a heat exchanger interposed between said burner and said compressor and operatively associated with said combustor for transferring heat from said combustor to said compressed air stream.

20. Apparatus according to claim 12 including:

a) a gas turbine unit having a compressor for compressing ambient air and producing a compressed air stream, a burner to which said compressed air stream is supplied and to which is supplied said non-asphaltene product from said apparatus for heating the air and producing a heated stream of air, and a gas turbine responsive to said heated stream of air for generating power and producing exhaust gases;

b) a waste heat boiler responsive to said exhaust gases for generating steam;

c) an air turbine unit having a compressor for compressing ambient air and producing a compressed air stream, a heat exchanger for heating the air and producing a heated stream of air, and an air turbine responsive to said heated stream of air for generating power and producing a heat-depleted stream of air;

d) a combustor for combusting asphaltenes from said product stream of asphaltenes produced by said apparatus, and producing combustion gases;

e) said heat exchanger being responsive to said combustor for supplying heat to said compressed air stream;

f) a waste heat boiler responsive to said combustion gases for generating steam; and g) a steam turbine responsive to steam from a waste heat boiler for producing power.

21. In combination:

a) a power generator system including a prime mover that generates power and produces waste heat;

b) a solvent deasphalting unit utilizing a solvent having a critical temperature $T_c$ that receives a hydrocarbon feed with an atmospheric boiling temperature treater than about $T_f°$ F. for producing a substantially solvent-free asphaltene product, and a substantially solvent-free nonasphaltene product in response to input heat, and wherein $T_f$ is greater than about $T_c$–50° F.; and c) means for using said waste heat to supply said input heat.

22. Apparatus according to claim 12 including a prime mover operating on a non-asphaltene product stream produced by said apparatus for generating power and exhaust gases.

23. Apparatus according to claim 22 including means responsive to said exhaust gases for transferring heat to said apparatus.

24. Apparatus comprising:

a) a fractionator for receiving a hydrocarbon input stream and separating the same into fractions with an atmospheric equivalent boiling temperature less than about $T_f°$ F. ($T_f^-$ fractions) thereby producing a product stream that consists of $T_f^-$ fractions and a residue stream ($T_f^+$ stream);

b) a solvent deasphalting (SDA) unit utilizing a solvent having a critical temperature $T_c$ for receiving said residue stream and for producing a first product stream of substantially solvent-free asphaltenes, and a second product stream containing substantially solvent-free deasphalted oil (DAO), and wherein $T_f$ is greater than-about $T_c$–50° F.; and c) a thermal cracker for thermally cracking the DAO in said second product stream for producing an output stream that includes thermally cracked fractions and by-product asphaltenes produced by thermally cracking the DAO, such that at least some of said output stream is fed back to said fractionator whereby said input stream includes at least some of said output stream.

25. Apparatus according to claim 24 comprising:

a) a prime mover fueled by said $T_f^-$ fractions for producing power and waste heat;

b) a combustor fueled by said first product stream for producing combustion products;

c) a boiler responsive to said waste heat and said combustion products for generating steam from condensate;

d) a steam turbine for expanding said steam thereby generating power and producing expanded steam; and e) a steam condenser for condensing said expanded steam and producing said condensate.

26. Apparatus according to claim 25 wherein said combustor also combusts oil shale.

27. Apparatus according to claim 24 comprising:

a) a prime mover fueled by said $T_f^-$ fractions for producing power and exhaust gases;

b) a fluidized bed combustor that receives said exhaust gases and burns said first product stream for producing combustion products;

c) a boiler responsive to said combustion products for generating steam from condensate;

d) a steam turbine for expanding said steam thereby generating power and producing expanded steam; and e) a steam condenser for condensing said expanded steam and producing said condensate.

28. Apparatus according to claim 27 wherein said combustor also combusts oil shale.

* * * * *